US005779032A

United States Patent [19]

Iimura et al.

[11] Patent Number: 5,779,032

[45] Date of Patent: Jul. 14, 1998

[54] ACCESSORY BOX WITH REMOTE CONTROL OPENING DEVICE

[75] Inventors: Taichi Iimura; Hiroyasu Inagawa, both of Tokyo, Japan

[73] Assignee: Tomy Company, Ltd., Tokyo, Japan

[21] Appl. No.: 654,580

[22] Filed: May 29, 1996

[51] Int. Cl.[6] ..... A47F 7/02

[52] U.S. Cl. ..... 206/6.1; 206/459.1; 220/211; 220/260; 318/16

[58] Field of Search ..... 220/211, 260; 318/16; 206/459.1, 459.5, 457, 6.1, 566; 116/100

[56] References Cited

U.S. PATENT DOCUMENTS 4,787,516 11/1988 Morrison ..... 206/6.1 X 5,303,972 4/1994 Heider et al. ..... 318/16 X 5,329,212 7/1994 Feigleson ..... 220/260 X

*Primary Examiner*—Jacob K. Ackun

*Attorney, Agent, or Firm*—Staas & Halsey

[57] ABSTRACT

An accessory containing device having a portion for containing accessories and lids adapted to the opened and closed, a controller remote from the accessory containing box for emitting infrared rays, and a mechanism for opening and closing the lids including a motor, a light receiving element for receiving the infrared rays from the controller and a mechanism for operating the lids with the power of the motor when the light receiving element receives the infrared rays.

6 Claims, 8 Drawing Sheets

ACCESSORY BOX WITH REMOTE CONTROL OPENING DEVICE

BACKGROUND AND SUMMARY OF THE INVENTION

Accessory boxes for holding jewelry and the like are well known and are usually provided with covers or lids which open and close. Frequently there is provided a music producing mechanism activated by the opening of the lid. In such accessory boxes the top or lid must be manually opened. In addition, surface ornamentation of the box is usually without imagination.

It is an object of the present invention to increase the interest of the user by providing for the remote control opening and closing of the lid, providing a visual display of the contents of the box and providing desired music or other sound as the lid is opened and closed.

The accessory or jewelry box of the present invention is provided with lids which are adapted to open and close and a manually operable controller separate from the box which emits infrared rays. The accessory containing box is provided with a battery, a motor driven by the battery, a lid opening and closing mechanism operated by the motor, a light receiving element for receiving the infrared rays from the controller and a control mechanism for operating the lid opening and closing mechanism by operation of the motor when the light receiving element is exposed to the infrared rays. The accessories or jewelry within the box are visually exposed from at least the diagonally upper front of the box when the lid is closed. Finally, there is further provided a sound producing mechanism which is activated when the lids of the box are opened or closed.

From the foregoing, it will be apparent that when the user operates the controller directing infrared rays towards the light receiving element of the accessory containing box, the lid is automatically opened adding an element of excitement. Moreover, since the accessories contained within the box can be seen through the diagonally upward front of the box, the accessories effectively function as decoration for the accessory containing box.

DESCRIPTION OF THE PREFERRED EMBODIMENTS

Figure 1:
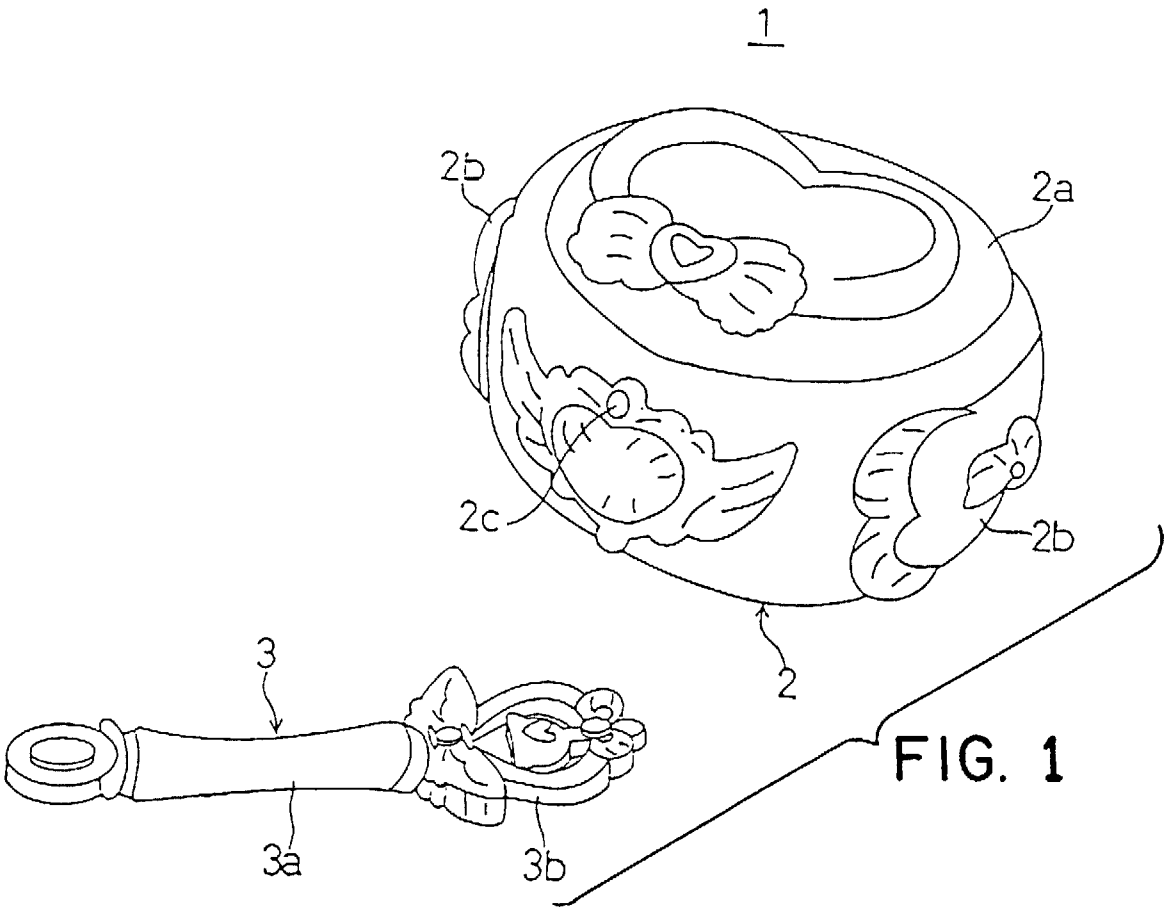
FIG. 1 is a perspective view of the accessory containing device according to one embodiment of the present invention.
Figure 2:
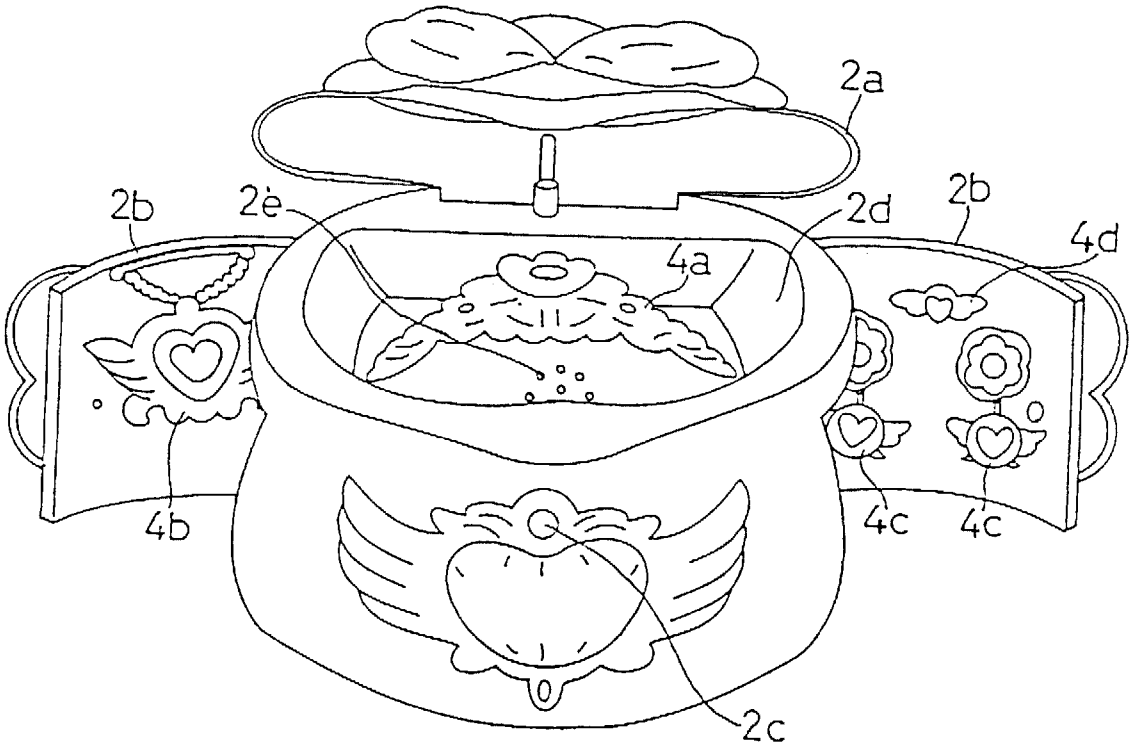
FIG. 2 is a perspective view of the accessory containing box when the lid is open.

As seen in FIGS. 1–2, the accessory containing device is generally designated by the reference numeral 1 and consists of a box 2 having an upper lid 2*a*, side lids 2*b* and a controller 3 which emits infrared rays on demand. The box 1 is provided with a receiver 2*c* positioned along the front surface of the box 1 for receiving infrared rays of energy generated by the controller 3.

As seen in FIG. 2, when infrared radiation is generated from the controller 3 and received by the receiver 2*c*, the upper lid 2*a* and the side lids 2*b* are automatically opened. In like manner operation of the controller 3 closes the lids 2*a* and *b*.

That portion of the box which is effectively closed by the upper lid 2*a* is provided with a chamber or receiving portion 2*d*. By way of exemplification a crown (jewelry) 4*a* may be contained within the chamber 2*d*.

The portions of the box 1 closed by the lateral or side lids 2*b* are provided with receiving portions. A necklace 4*b*, earrings 4*c* and a ring 4*d* are depicted in FIG. 2 as being attached to the rear surface of the lids 2*b*.

From the foregoing it will be apparent that the upper lid 2*a* and the side lids 2*b* may be automatically opened by emitting infrared rays from the controller 3 toward the receiving portion 2*c*, such that the crown 4*a*, the necklace 4*b*, the earrings 4*c* and the ring 4*d* can be removed, as seen in FIG. 2. Moreover, the center portion of the upper lid 2*a* is transparent; thus the crown 4*a* can be seen from above even when the upper lid 2*a* is closed. Finally, a group of sound emitting opening or ports 2*e* are disposed within the floor of the chamber 2*d*. When the upper lid 2*a* is opened sounds are emitted through the openings 2*e*.

Figure 3:
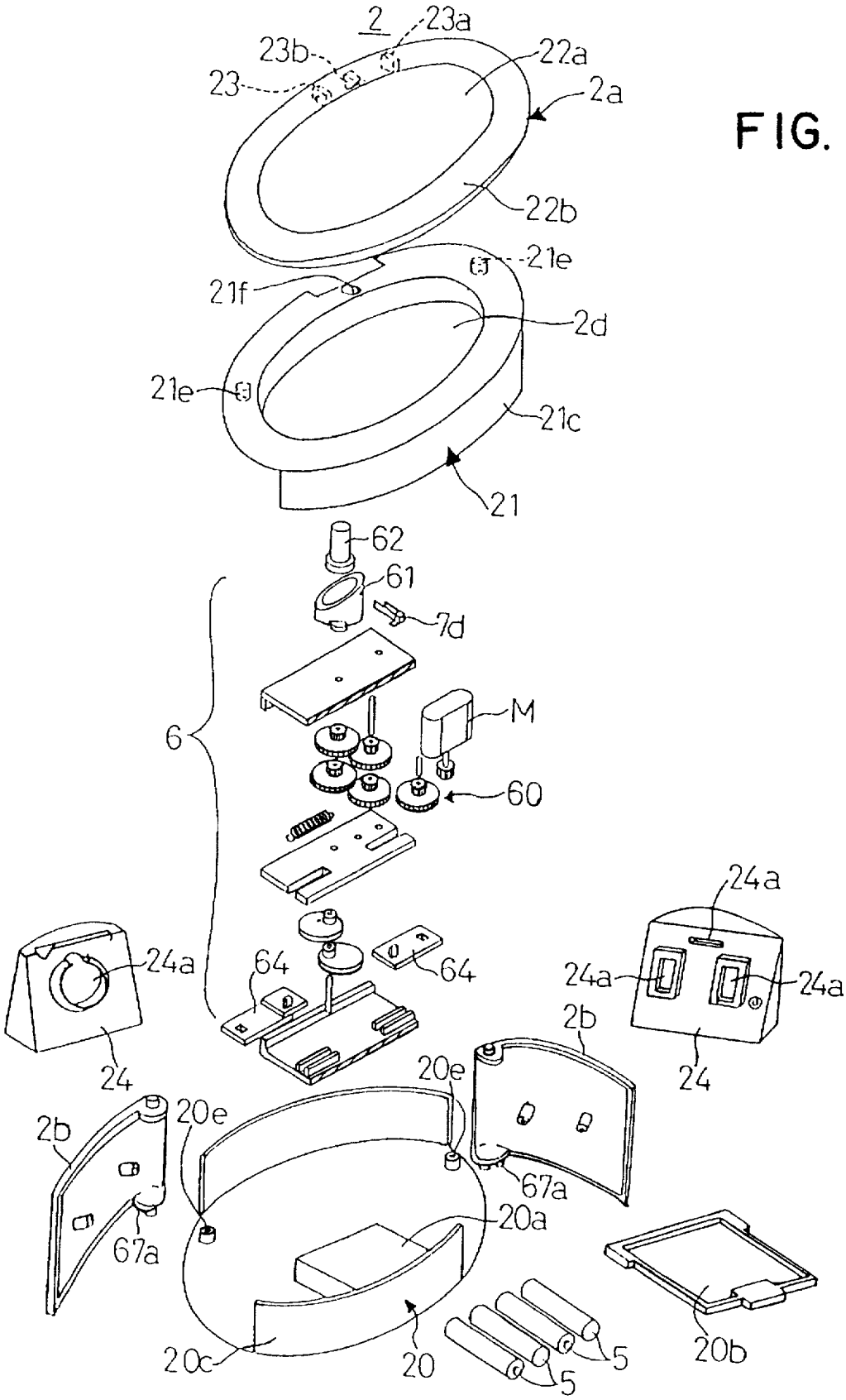
FIG. 3 is an exploded perspective view of the accessory containing box illustrating the operative components thereof.

Turning now to FIG. 3, it will be apparent that the accessory containing box 2 consists of a base having a lower frame 20 and a base upper frame 21. The upper lid 2*a* and side lids 2*b* are attached to the base lower frame 20 and the base upper frame 21.

The base lower frame 20 is provided with a box 20*a* which may be opened and closed in conventional manner and into which the batteries 5 are inserted from below. The outer circumferential wall 20*c* is provided with appropriate notches to support the lateral lids 2*b* as described hereinafter.

A recess portion defining the floor surface and a circumferential wall of the accessory containing chamber 2*d* is disposed on the base upper frame 21. The outer circumferential wall 20*c* is provided with a notched arrangement supporting the lateral lid attaching portion, as described hereinafter.

The upper lid 2*a* consists of a transparent plate 22*a* at the center thereof and a holding frame 22*b* at the circumferential edge portion thereof. A pair of bearing pieces 23*a* are positioned on the lower side of the holding frame 22*b* and a shaft (not shown) passes through the bearing pieces 23*a*. The upper lid 2*a* is thereby attached to the base upper frame 21 so as to be capable of opening and closing.

An interior support 24 is attached by screws or other fasteners to the inner side of each of the lateral lids 2*d*. Various accessory supporting and attaching portions 24*a* of the fit-in-type are disposed along the interior of the supporting element 24, thus permitting the accessories, for example, jewelry, to be inserted and held in place, as previously described. Each of the lateral lids 2*d* is rotatably mounted about a bearing portion 20*e* of the base lower frame 20 and a bearing portion of the base upper frame 21.

As further seen in FIG. 3, the motor M is provided with a source of electrical energy, i.e., the batteries 5. A lid opening and closing mechanism 6, driven by the motor M, opens and closes the upper lid 2*a* and the lateral or side lids 2b. The lid opening-closing mechanism 6 includes a gear mechanism generally designated by the reference numeral 60. As illustrated in detail in FIG. 4,. an upper lid cam 61, upper lid pushing part 62, a lateral lid cam 63 and sliders 64 (FIG. 4) are employed.

The lid opening and closing mechanism 6 transmits the power of motor M to a shaft 65 through the gear mechanism 60 (gears 60a to 60j) to thereby move the upward lid cam 61. The upper lid cam 61 includes at its upper surface the face cam with which the upper lid pushing part 62 engages. The head of the upper lid pushing part 62 is in contact with a rectangular abutting portion 23b which is disposed below the upper lid 2a through a hole 21f within the base upper frame 21, as seen in FIG. 3. As a result, when the upper lid cam 61 rotates the upper lid pushing part 62 moves upwardly or downwardly, such that the upper lid 2a is opened or closed.

Figure 4:
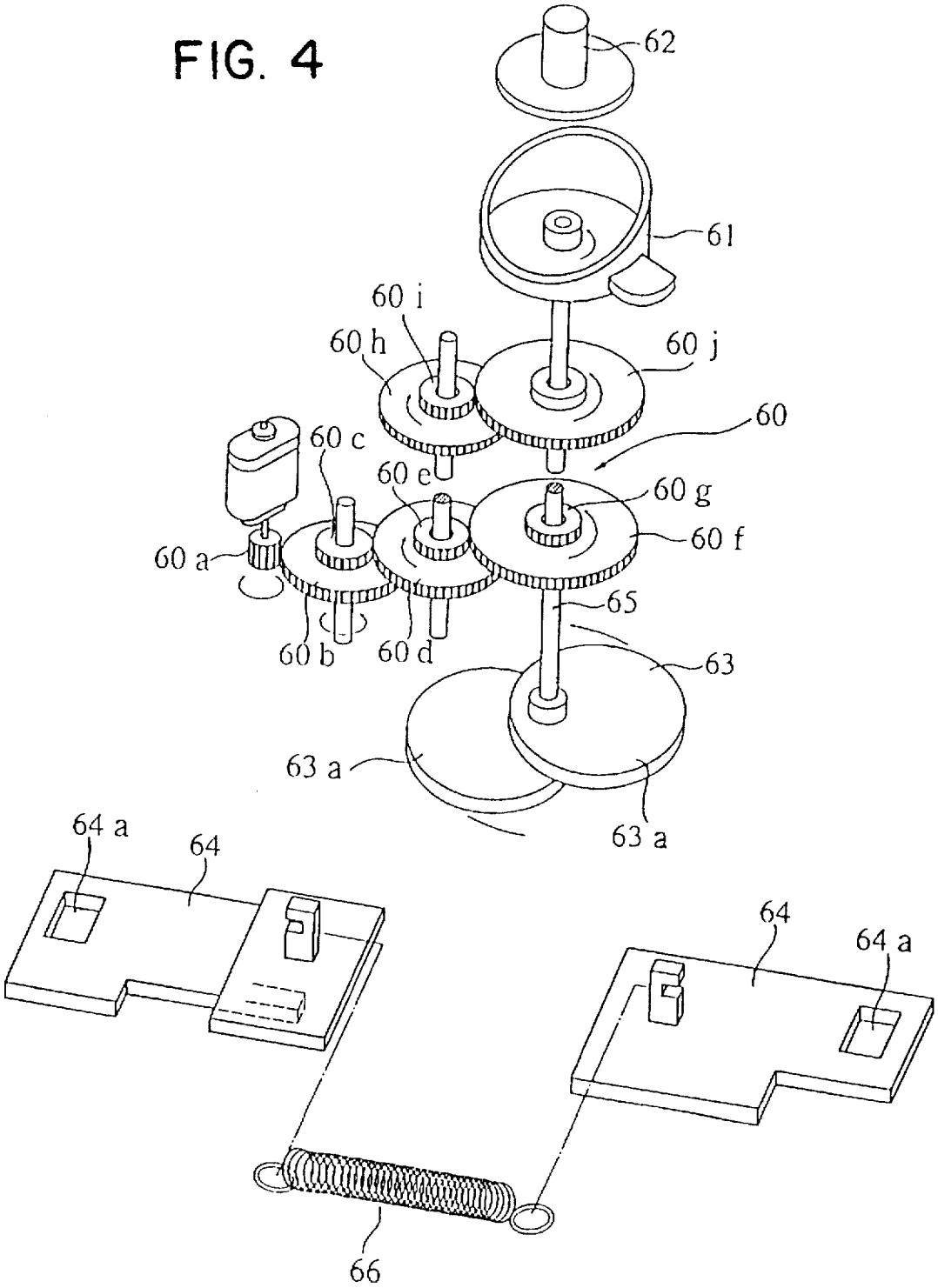
FIG. 4 is a perspective view of certain of the internal operating mechanisms of the accessory containing box.

The lid opening and closing mechanism 6 is adapted to transmit the power of the motor M to the shaft 65 to the gear mechanism 60 (the gear 60a–60j) to thereby move the lateral lid cam 63, as seen in FIG. 4. The lateral lid cam 63 consists of two eccentric cams 63a which are fastened to each other and spaced apart by 180°. Sliders 64, as seen in FIG. 4 are disposed on the left and right sides of the lateral lid cam 63. The sliders 64 are moved in such direction to come close to each other. The inner end of each of the sliders 64 is pushed towards the eccentric cam 63a. A rectangular elongated hole 64a is disposed on the outer end portion of each of the sliders 64. A projection 97a of the lateral lid 2b fits within the elongated hole 64a leaving a slight gap. As a result, when the lateral lid cam 63 rotates, the sliders 64 separate from each other, or move towards each other, such that the lateral lids 2b are opened or closed, respectively.

Figure 5:
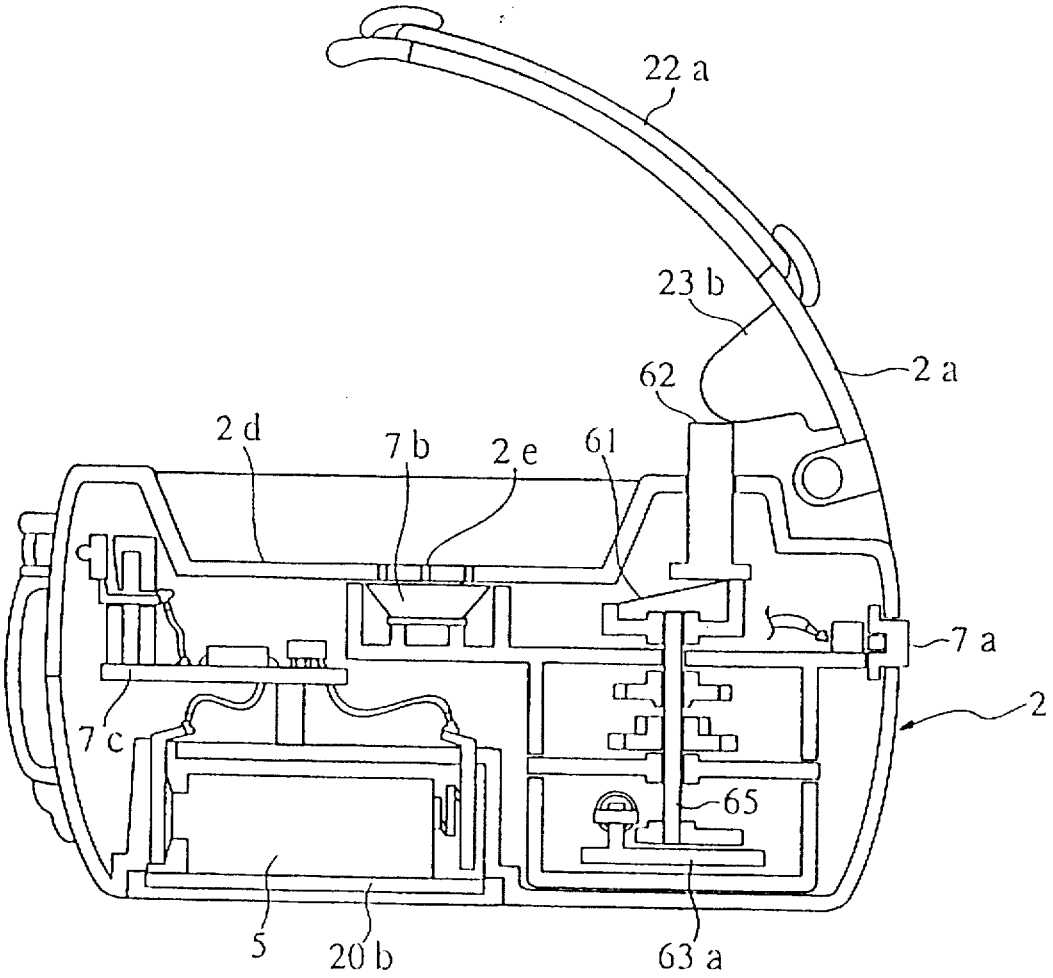
FIG. 5 is a sectional view of the accessory containing box.
Figure 8A:
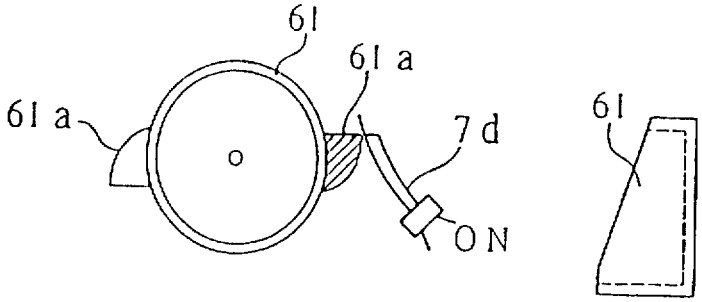
FIGS. 8(*a*)–(*c*) are diagrams depicting the engaging relationship between the upper lid cam and the motor leaf switch which is turned on and off by the cam.
Figure 8B:
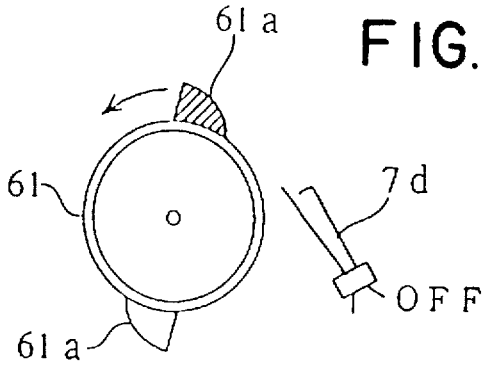
Figure 8C:
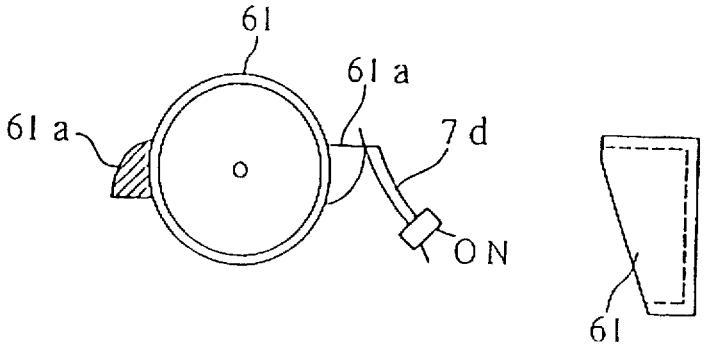

Turning now to FIG. 5, an electric switch 7a is provided within the accessory containing box 2, along with a speaker 7b and a circuit board 7c which mounts LSI and other electronic parts as discussed hereinafter. A motor leaf switch 7d is positioned near the upper lid cam 61, as seen in FIG. 8. This motor leaf switch. 7d is turned on and off by the projections 61a which are disposed around the upper lid cam 61. When the upper lid 2a and the lateral or side lids 2b are closed, as seen in FIG. 8(a), the motor leaf switch 7d is turned on. When the upper lid 2a and the lateral lids 2b start to open, as seen in FIG. 8(b), the motor leaf switch 7d is turned off. When the upper lid 2a and the lateral lids 2b are opened, as seen in FIG. 8(c), the motor leaf switch 7d is turned on.

Figure 6:
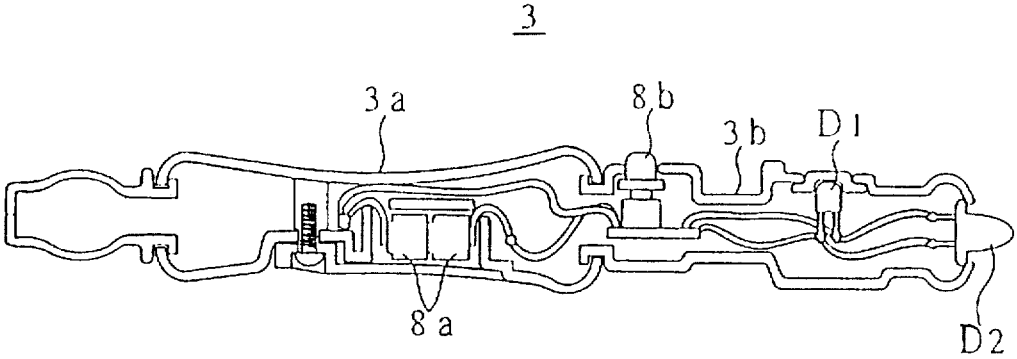
FIG. 6 is a longitudinal sectional view of the controller of the present invention.

Returning to FIG. 1, the controller 3 is elongated and includes a grip 3a and a decorated and portion 3b. The grip 3a is provided with a battery 8a (as seen in FIG. 6) while the decorated portion 3b is provided with a push button 8b, a transmission displaying diode D1 and an infrared light emitting diode D2, as seen in FIG. 6.

Figure 7:
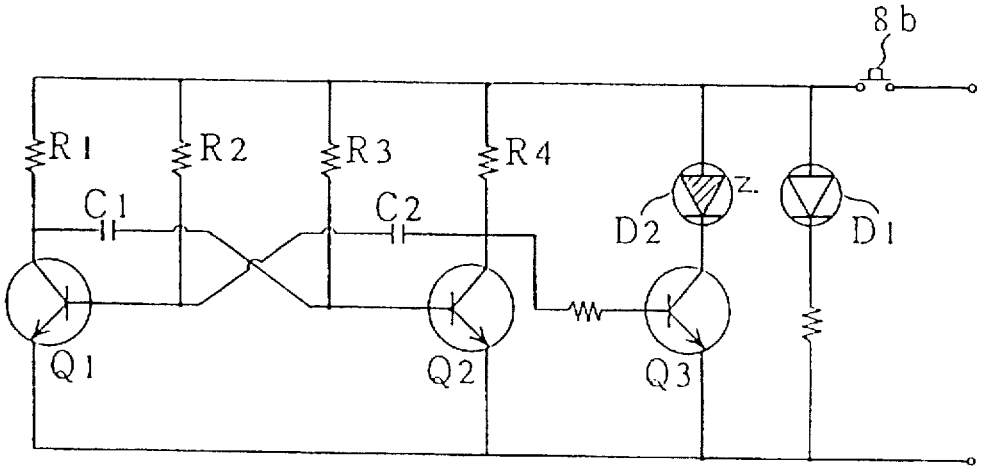
FIG. 7 is a circuit diagram of the operative components of the controller.

The electric circuit within the controller 3 will now be explained with reference to FIG. 7. Transistors Q1 and Q2, resistors R1–R4 and condensers C1 and C2 comprise a stable multivibrator. When the button 8b is depressed, the transistors Q1 and Q2 are turned on or off repeatedly to thereby generate rectangular pulses. Due to the rectangular pulses, the transistor Q3 is turned either on or off, after which the infrared light emitting diode D2 flickers. When the button 8b is pushed down again the transmission displaying diode D1 is turned on.

Figure 9:
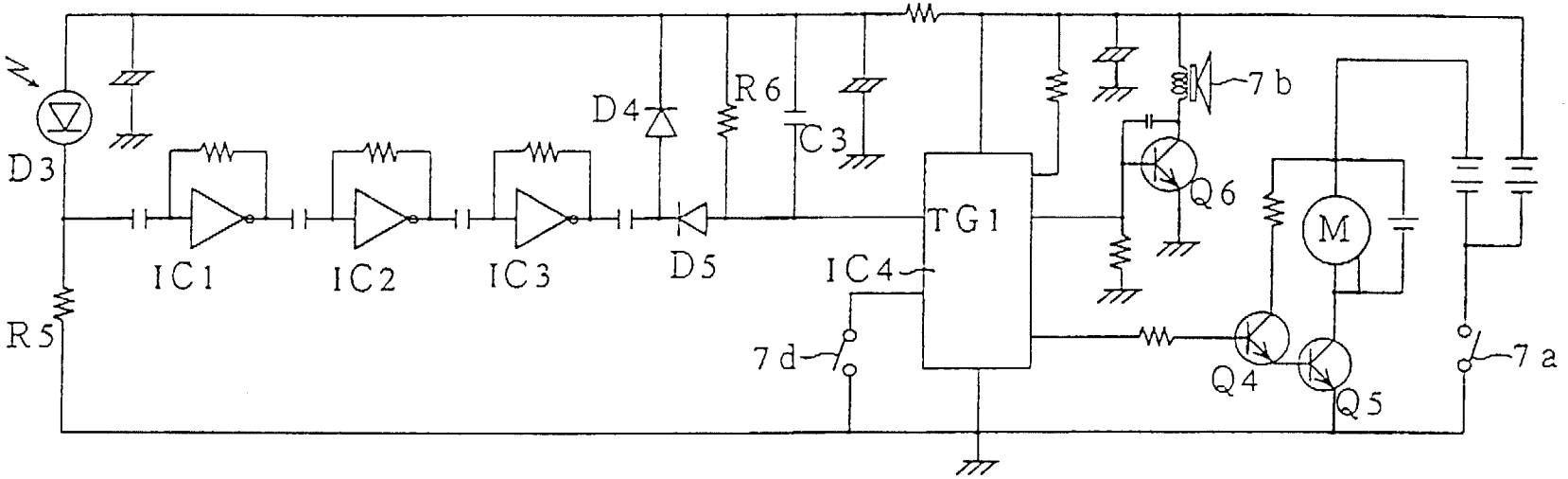
FIG. 9 is a circuit diagram of the operative components of the accessory containing box.

The receiving electrical circuit will now be described with reference to FIG. 9. When the infrared rays emitted from the transmission display diode D2 enter the light receiving diode D3, i.e., the light receiving element D3, the light receiving diode D3 switches at a modulation frequency of the infrared rays, so that the electrical source voltage is applied to the transistor R5. Invertors IC1 to IC3 comprise an inverted amplifying circuit. The voltage applied to the resistor R5 is amplified. This amplified voltage is outputted to a rectifying circuit comprised diodes D4 and D5. This circuit rectifies the end putted voltage. Thus, when the infrared rays are inputted, the rectified negative voltage is generated on the side of an anode of the diode R5. The resistor R6 and the condenser C3 constitute a time constant circuit. An anode side of the diode D5 is pulled up by the resistor R6 on normal condition. In this condition, when the negative voltage is inputted to the cathode side of the diode D5, the anode side of the diode D5 results in earth potential. When the anode side of the diode D results in earth potential, the time constant circuit holds the anode side potential at the earth potential by the time corresponding to the time constant. In this case where an input port TGI results in earth potential when the motor leaf switch is turned on, the integrated circuit IC4 operates the motor driven transistors Q4 and Q5 to drive the motor M by outputting the high level voltage to the motor driving port.

Simultaneously therewith, the integrating circuit IC4 reads out a voice data on order from voice memory, for storing the voice data for emitting a predetermined voice, and outputs a high level voice signal based on the readout voice data through the speaker 7.

When the motor M is energized, the motor leaf switch 7 is turned off. The motor leaf switch 7 is turned on again when the upper lid cam 61 rotates a half revolution. When the motor leaf switch 7 is turned on, the integrated circuit IC4 stops the output of the high level signal from the motor driving port and stops the motor M, and then stops output of the voice data. The integrated circuit then IC4 assumes its base-by condition.

Returning now to the overall operation of the accessory containing device 1, it will be apparent that when the infrared rays are emitted from the controller 3 and directed towards the receiving port 2c of the accessory containing box 2, the upper lid 2a and the lateral lids 2b, are opened. The accessories contained inside portions of the box 1 can be seen from the front side of the box. As the upper lid 2a and the side lids 2b are opened and closed, sounds are emitted to the pleasure of the user.

It will be apparent that the invention disclosed therein is not limited to the preferred embodiment described above.

What is claimed is:

1. A device, comprising:

a container with a compartment for holding one or more accessories, at least one lid mounted for movement relative to the container between an open position wherein the accessory may be removed from the compartment and a closed position, a motor, a mechanism operatively connected the motor to the lid to move same between the open and closed positions and a receiver for energizing the motor to operate the lid in response to receiving a predetermined signal, and a manually operable remote controller for emitting the signal to operate the accessory containing device, wherein said at least one lid comprises a first lid positioned generally at the top of the accessory contained device and in addition thereto second and third lids mounted generally at the sides of the device, and wherein the mechanism operatively connecting the motor and said at least one lid operatively connects said second and third lids.

2. An accessory contained device as in claim 1, wherein the signals transmitted from the controller are infrared rays and, wherein the receiving means includes a light receiving element for receiving the infrared rays generated by the controller.

3. An accessory contained device as in claim 1, wherein at least portion of said at least one lid is transparent thus permitting at least a portion of the contents of the accessory containing device to be seen when the lid is closed.

4. An accessory containing device as in claim 1, further comprising accessory attaching portions provided on the inside surfaces of the lids to which accessories may be attached and removed.

5. An accessory contained device as in claim 4, further comprising means for emitting sound as said lids are opened and closed.

6. An accessory containing device as in claim 1, wherein the remote controller includes an infrared light emitting diode and wherein the receiving means includes a light receiving diode.

* * * * *

UNITED STATES PATENT AND TRADEMARK OFFICE

CERTIFICATE OF CORRECTION

PATENT NO. : 5,779,032

DATED : July 14, 1998

INVENTOR(S) : Iimura et al.

It is certified that error appears in the above-identified patent and that said Letters Patent is hereby corrected as shown below:

Cover page, add foreign application priority data as follows:

-- Japan 7-006296 May 31, 1995 --

Signed and Sealed this

Twenty-sixth Day of January, 1999

*Attest:*

*Attesting Officer*

*Acting Commissioner of Patents and Trademarks*